US005915933A

United States Patent [19]

Iizuka et al.

[11] Patent Number: 5,915,933

[45] Date of Patent: Jun. 29, 1999

[54] ROTATION PREVENTING MECHANISM FOR FLUID DISPLACEMENT APPARATUS

[75] Inventors: Jiro Iizuka, Takasaki; Shinichi Ohtake, Ashikaga, both of Japan

[73] Assignee: Sanden Corporation, Gunma, Japan

[21] Appl. No.: 08/856,811

[22] Filed: May 15, 1997

[30] Foreign Application Priority Data

May 15, 1996 [JP] Japan ..... P08-120200

[51] Int. Cl.[6] ..... F01C 1/04; F16D 3/04

[52] U.S. Cl. ..... 418/55.3; 29/888.022; 464/103

[58] Field of Search ..... 418/55.3; 29/407.09, 29/464, 888.022; 464/102, 103

[56] References Cited

U.S. PATENT DOCUMENTS

| | | | |
|---|---|---|---|
| 4,259,043 | 3/1981 | Hidden et al. | 418/55.3 |
| 4,325,683 | 4/1982 | Miyazawa | 418/55.3 |
| 4,406,600 | 9/1983 | Terauchi et al. | 418/55.3 |
| 4,457,676 | 7/1984 | Hiraga | 418/57 |
| 4,468,181 | 8/1984 | Sakamoto | 418/55.3 |
| 4,474,543 | 10/1984 | Hiraga et al. | 418/55.3 |
| 4,492,543 | 1/1985 | Iimori et al. | 418/55.3 |
| 4,545,746 | 10/1985 | Sugimoto et al. | 418/55.3 |
| 4,589,828 | 5/1986 | Sato et al. | 418/55.3 |
| 4,645,435 | 2/1987 | Sugimoto | 418/55.3 |
| 4,934,909 | 6/1990 | Suzuki et al. | 418/55.3 |
| 5,102,315 | 4/1992 | Terauchi et al. | 418/55.3 |
| 5,423,663 | 6/1995 | Fukui | 418/55.3 |
| 5,435,706 | 7/1995 | Matsumoto et al. | 418/55.3 |

FOREIGN PATENT DOCUMENTS

| | | | |
|---|---|---|---|
| 63-192979 | 8/1988 | Japan . | |
| 177779 | 3/1989 | Japan . | |
| 1182587 | 7/1989 | Japan . | |
| 2308990 | 12/1990 | Japan | 418/55.3 |

*Primary Examiner*—John J. Vrablik

*Attorney, Agent, or Firm*—Baker & Botts, L.L.P.

[57] ABSTRACT

A scroll type fluid displacement apparatus comprises a housing having a front end plate and at least one hole formed on an inner surface thereof, a fixed member attached to the housing, an orbiting ring assembly including an orbiting member having an end plate from which an annular member extends, and an orbiting ring fastened to an axial end surface of said end plate of said orbiting member. The orbiting member has at least one hole formed on the axial end surface thereof. The scroll type fluid displacement further comprises a fixed ring assembly attached to the housing, including a fixed ring fastened to an inner surface of the housing facing the orbiting ring of the orbiting assembly. Each of the fixed and orbiting rings have a plurality of corresponding pockets, each pocket on the fixed ring facing a pocket on the orbiting ring of approximately the same size, pitch, and radial distance, and at least one opening formed in each of said fixed and orbiting rings. A rotation preventing and thrust bearing means is connected to the orbiting assembly for carrying axial loads from said orbiting assembly and preventing the rotation of said orbiting assembly, so that at least one line contact moves toward a compressor discharge side during orbital motion. The rotation preventing and thrust bearing means further includes a plurality of bearing elements, one each being placed within each pair of facing pockets. The corresponding pockets including a predetermined number of rotation preventing pockets on each of the fixed and orbiting rings for interacting with the bearing elements to prevent rotation of the orbiting member during orbital motion. Each of at least one hole of the inner surface of the housing and at least one hole in the axial end of the orbiting scroll member has a diameter smaller than that of each of said at least one opening of the fixed ring and said at least one opening of the orbiting ring, such that the eccentric relationships between the centers of said openings can be measured with respect to the centers of said holes. The rotation preventing and thrust bearing means can then be assembled using a fixed ring assembly and an orbiting ring assembly which have the same or substantially similar eccentric characteristics.

12 Claims, 10 Drawing Sheets

ROTATION PREVENTING MECHANISM FOR FLUID DISPLACEMENT APPARATUS

BACKGROUND OF THE INVENTION

1. Field of the Invention

The present invention relates to a rotation prevention mechanism for a fluid displacement apparatus.

2. Description of the Prior Art

Scroll type fluid displacement apparatuses are known in the art. For example, U.S. Pat. No. 5,102,315, which are incorporated herein by reference, describes a typical apparatus.

Referring to FIG. 1, a fluid displacement apparatus in accordance with the prior art is shown in the form of a scroll type refrigerant compressor unit 100. Compressor unit includes a compressor housing 10 having a front end plate 11 and a cup-shaped casing 12 attached to an end surface of front end plate 11.

An opening 111 is formed in the center of the front end plate 11 to permit passage of a drive shaft 13. An annular projection 112 is formed in a rear end surface of front end plate 11, which faces cup-shaped casing 12. Annular projection 112 is concentric with opening 111. An outer peripheral surface of annular projection 112 extends into an inner wall of the opening of cup-shaped casing 12. Cup-shaped casing 12 is fixed on the rear end surface of front end plate 11 by a fastening device, for example, bolts and nuts, so that the opening of cup-shaped casing 12 is covered by front end plate 11. An O-ring 14 is placed between the outer peripheral surface of annular projection 112 and the inner wall of the opening of cup-shaped casing 12 to seal the mating surface of front end plate 11 and cup-shaped casing 12. Front end plate 11 has an annular sleeve 15 integrally projecting from the front end surface thereof which surrounds drive shaft 13 and defines a shaft seal cavity.

Drive shaft 13 is rotatably supported by sleeve 15 through a bearing 17 located near the front end of sleeve 15. Drive shaft 13 has a disk 18 at its inner end which is rotatably supported by front end plate 11 through a bearing 19 located within opening 111 of front end plate 11. A shaft seal assembly 20 is coupled to drive shaft within the shaft seal cavity of sleeve 15.

A magnetic clutch includes a pulley 21, an electromagnetic coil 23, and an armature plate 25. The pulley 21 is rotatably supported by a bearing 22 which is located on an outer surface of sleeve 15. The electromagnetic coil 23, which surrounds sleeve 15, is supported by a support plate 24 in an annular cavity of pulley 21. The armature plate 25 is elastically supported on the outer end of drive shaft 13 which extends from sleeve 15. In operation, drive shaft 13 is driven by an external drive power source, for example, a vehicle engine, through a rotation force transmitting device, such as the magnetic clutch described above.

A fixed scroll 26, an orbiting scroll 27, a driving mechanism for orbiting scroll 27, and a rotation reventing and thrust bearing device for orbiting scroll 27 are located within an inner chamber of cup-shaped casing 12. The inner chamber is formed between the inner wall of cup-shaped casing 12 and front end plate 11.

Fixed scroll 26 includes circular end plate 261, a wrap or spiral element 262 affixed to or extending from an end surface of circular end plate 261, and a plurality of internally threaded bosses 263 axially projecting from the other end surface of circular plate 261. An axial end surface of each boss 263 is seated on the inner surface of an end plate 121 of cup-shaped casing 12 and fixed by bolts 28. Thus, fixed scroll 26 is fixed within the cup-shaped casing 12. Circular plate 261 of fixed scroll 26 divides the inner chamber of cup-shaped casing 12 into a discharge chamber 30 and suction chamber 29. A seal ring 132 is located between the outer peripheral surface of circular plate 261 and the inner wall of cup-shaped casing 12. A hole or discharge port 264 is formed through circular plate 261 at a position near the center of spiral element 262. Discharge port 264 is connected between the central fluid pockets of the spiral element 262 and discharge chamber 30.

Orbiting scroll 27 also includes a circular end plate 271 and a wrap or spiral element 272 affixed to or extending from one end surface of circular end plate 271. Spiral element 272 of orbiting scroll 27 and spiral element 262 of fixed scroll 26 interfit at an angular offset of 180 degrees and a predetermined radial offset. At least one air of fluid pockets are thereby defined between spiral elements 262 and 272. Orbiting scroll 27, which is connected to drive mechanism and to the rotation preventing and thrust bearing device, is driven in an orbital motion at a circular radius $R_o$ by drive shaft 13 to compress fluid passing through compressor unit 100. Generally, radius $R_o$ of orbital motion is given by the following formula:

$$R_o=[(\text{pitch of spiral element})-2\times(\text{wall thickness of spiral element})]/2$$

The spiral element 272 is radially offset from spiral element 262 of fixed scroll member 26 by distance $R_o$. Thus, orbiting scroll 27 undergoes orbital motion of a radius $R_o$upon rotation of drive shaft 13.

Drive shaft 13, which is rotatably supported by sleeve 15 through bearing 17, is connected to disk 18. Disk 18 is rotatably supported by front end plate 11 through bearing 19 disposed within opening 111 of front end plate 11. A crank or drive in 33 axially projects from an axial end surface of disk 18 at a position which is radially offset from the center of drive shaft 13. Circular plate 271 of orbiting scroll 27 has a tubular boss 273 axially rejecting from the end surface opposite the surface from which spiral element 272 extends. A discoid or short axial bushing 34 fits into boss 273 and is rotatably supported therein by a bearing, such as a needle bearing 35. Bushing 34 has a balance weight 341 which has the shape of a semi-disk or ring radially connected to bushing 34 along a front surface thereof. An eccentric hole 342 is formed in bushing 34 at a position radially offset from the center of bushing 34. Drive in 33 fits into eccentric hole 342. Bushing 34, which is driven by the revolution of drive in 33, rotates within bearing 35.

The rotation of orbiting scroll 27 is prevented by a rotation preventing and thrust bearing device positioned between the inner wall of the housing 10 and circular plate 271 of orbiting scroll 27 and around boss 273 of orbiting scroll 27. As a result, orbiting scroll 27 orbits while maintaining its angular orientation relative to fixed scroll 26.

Referring to FIGS. 2, 3, 4 and 5, rotation preventing and thrust bearing device is provided with an annular fixed race 130, an annular orbital race 131, and bearings, such as a plurality of balls 137. Annular fixed race 130 is secured to axial end surface 113 of front end plate 11 by a plurality of fixed pins 138. Orbital race 131 is secured to end surface 271*a* of circular plate 271 of orbiting scroll 27 by a plurality of fixed pins 139. Annular fixed race 130 and annular orbiting race 131 each have a plurality of pockets 130*a* and 131*a*, respectively, in an axial direction preferably formed by a press working process. The number of pockets in each race 130 and 131 is equal. Annular fixed race 130 and annular orbiting race 131 face each other at a predetermined axial clearance. The radius of each pocket 130*a* of annular fixed race 130 is about the same as that of each pocket 131*a* of orbital race 131. Pockets 130*a* correspond generally in location to pockets 131*a*, i.e., each pair of pockets facing each other have the same pitch, and the radial distance of each set of pockets from the centers of their respective races is about equal.

Further, annular fixed race 130 includes a plurality of openings 130*b* formed on a circumference thereof at an angular interval. Front end plate 11 includes a pair of holes 114 formed thereon at the angular interval corresponding to the angular interval of opening 130*b*of annular fixed race 130. Annular fixed race 130 is secured to axial end surface 113 of front end plate 11 by fixed pins 138, such that fixed in 138 inserts into hole 114 of front end plate 11 through opening 130*b*. Furthermore, annular fixed race 130 may be secured to front end plate 11, such that radial inner end of axial end surface overlies radial edge of fixed race 130 by use of caulking.

Annular orbiting race 131 includes a plurality of openings 131*b* formed on a circumference thereof at an angular interval. Circular end plate 271 includes a pair of holes 275 formed thereon at the angular interval corresponding to the angular interval of opening 131*b* of annular orbital race 131. Annular orbital race 131 is secured to circular end plate 271 of orbiting scroll 27 by fixed pins 139, such that fixed in 139 inserts into hole 275 of orbiting scroll 27 through opening 131*b* of orbital race 131. Further, pockets 130*a* and 131*a* of annular fixed and orbital races 130 and 131, respectively, includes bottom lane portions axially offset from one end surface of annular fixed and orbital races 130 and 131, respectively. Centers of pockets 130*a* and 131*a* are formed on the circle of radius R about radial centers $O_1$ and $O_2$, respectively. A diameter of bottom portion of pockets 130*a* and 131*a* is designed to be substantially equal to radius $R_0$ which is the orbital radius of orbiting scroll 27. Center $O_1$ of fixed race 130 and center $O_2$ of orbital race 131 are designed to be coincident with center $O_a$ of front end plate 11 and center $O_b$ of orbiting scroll 27, respectively.

The operation of the compressor is described below. As the orbiting scroll 27 orbits, a plurality of line contacts between spiral elements 262 and 272 moves toward the center of the spiral elements along the surface of the spiral elements. The fluid pockets, which are defined by spiral elements 262 and 272, also move toward the center with a consequent reduction in volume and compression of the fluid in the fluid pockets. The fluid or refrigerant gas, which is introduced into suction chamber 29 from an external fluid circuit through inlet port 31 (not shown), is drawn into the fluid pockets formed between spiral elements 262 and 272 from the outer end of the spiral elements. As orbiting scroll 27 orbits, fluid in the fluid pockets is compressed, and the compressed fluid is discharged into discharge chamber 30 from the central fluid pocket of the spiral elements through discharge port 264. The fluid then is discharged to the external fluid circuit through an outlet port (not shown).

When orbiting scroll 27 is driven by rotation of drive shaft 13, the center $O_2$ of orbital race 131 orbits about a circle of radius $R_o$. However, a rotation force, i.e., moment, which is created by the offset of the acting point of the reaction force of compression and the acting point of the drive force, acts on orbiting scroll 27. This reaction force tends to rotate the orbiting scroll 27 about the center $O_2$ of orbiting race 131. Thus, the locus of the contact points of each ball 137 on each pair of pockets 130*a* and 131*a* generally outlines a circle having radius $R_o$, i.e., the traveling radius of each of ball 137 with respect to the axial end surface of fixed race 130 and orbital race 131 is defined by $R_o$. The rotation of orbiting scroll 27 is prevented by balls 137, each of which makes contact with walls of pockets 130*a* and 131*a* during operation while the angular relationship between fixed scroll 26 and orbiting scroll 27 is maintained. Moreover, the axial load from orbiting scroll 27, which is caused by the reaction force of the compressed gas, is carried by fixed race 130, orbital race 131, and balls 137.

In general, it is desired that a sealing force at the line contacts between spiral elements 262 and 272 be sufficiently maintained in a scroll type compressor, because the fluid pockets are defined by the line contacts between the two spiral elements which are intermitted together, and the line contacts shift along the surface of the spiral elements toward the center of spiral elements by the orbital motion of scroll member, to thereby move the fluid pockets to the center of the spiral elements with consequent reduction of volume, and compression of the fluid in the pockets. If contact force between the spiral element becomes too large in maintaining the sealing line contacts, wear of spiral elements increases. In view of this, the contact force of both spiral elements must be suitably maintained.

The operation of the rotation preventing/thrust bearing device is illustrated, in art, in FIG. 6. The center $O_2$ of orbital race 131 is shown at the right side of the center $O_1$ of fixed race 130, and the rotation direction of drive shaft 13 is clockwise as indicated by arrow "A." When orbiting scroll 27 is driven by the rotation of drive shaft 13, center $O_2$ of orbital race 131 orbits about a circle of radius "$R_o$" (together with orbiting scroll 27). However, an offset of the acting point of drive force, acts on orbiting scroll 27. This reaction force tends to rotate orbiting scroll 27 in a clockwise direction about center of orbital race 13 1. But, as shown in FIG. 6, balls 137 are laced between the corresponding pockets 130*a* and 131*a* of fixed and orbital races 130 and 131, respectively. In the position shown in FIG. 6, the interaction between the nine balls at the to of the rotation preventing/thrust bearing device and the edges of the pockets 130*a* and 131*a* prevents the rotation of orbiting scroll 27.

In the assembling of fixed race 130 and orbital race 131 to front end plate 11 and orbiting scroll 27, respectively, fixed race 130 and orbital race 131 may be eccentrically placed with respect to center $O_a$ of front end plate 11 and center $O_b$ of orbiting scroll 27, respectively. In other words, when fixed race 130 is re-assembled to front end plate 11, center $O_1$ of fixed race 130 may not be coincident with center $O_a$ of front end plate 11, and when orbiting scroll 27 is pre-assembled to orbital race 131, center $O_2$ of orbital race 131 may not be coincident with center $O^b$ of orbiting scroll 27.

As a result, when the orbiting orbital race 131 and orbiting scroll 27 are assembled to fixed race 130 and front end plate 11 by inserting boss 273 of orbiting scroll 27 into bushing 34 through bearing 35, center $O_2$ of orbital race 131 may not lie on a circle of radius $R_o$ formed about center $O_1$ of fixed race 130 because of the eccentricities between fixed race 130 and front end plate 11 and between orbiting race 13 1 and orbiting scroll 27. The offset is caused, in art, by dimensional errors in the manufacturing and assembling of fixed and orbital races 130 and 131.

The eccentricities described above reduce the ability of the compressor to maintain suitable contact between both spiral elements and cause balls 137 to run on edges of pockets 130*a* or 131*a* of races 130 or 131, respectively. As a result, the eccentricities reduce compression efficiency of the compressor and increase abrasion between fixed race 130 and orbital races 131.

An assembler may inspect for eccentricities by measuring the distortion of the orbiting locus of orbiting scroll 27, or after assembly, a sample of the compressors may be overhauled to observe abrasion vestiges between spiral elements 262 and 272 of fixed scroll 26 and orbiting scroll 27, respectively. Such production inspections, however, are complex to perform, consume much time, and do not provide precise measurements of the eccentricities.

SUMMARY OF THE INVENTION

It is an object of the invention to provide a fluid displacement apparatus which has an excellent contact sealing of the fluid pockets and of spiral elements.

It is another object of the resent invention to provide a high quality fluid displacement apparatus that can be consistently produced.

An improved scroll type fluid displacement apparatus comprises a housing having a front end plate and at least one hole formed on an inner surface thereof, a fixed member attached to the housing, an orbiting ring assembly including an orbiting member having an end plate from which an annular member extends, and an orbiting ring fastened to an axial end surface of said end plate of said orbiting member. The orbiting member has at least one hole formed on the axial end surface thereof. The scroll type fluid displacement further comprises a fixed ring assembly attached to the housing, including a fixed ring fastened to an inner surface of the housing facing the orbiting ring of the orbiting assembly. Each of the fixed and orbiting rings have a plurality of corresponding pockets, each pocket on the fixed ring facing a pocket on the orbiting ring of approximately the same size, pitch, and radial distance, and at least one opening formed in each of said fixed and orbiting rings. A rotation preventing and thrust bearing means is connected to the orbiting assembly for carrying axial loads from said orbiting assembly and preventing the rotation of said orbiting assembly, so that at least one line contact moves toward a compressor discharge side during orbital motion. The rotation preventing and thrust bearing means further includes a plurality of bearing elements, one each being placed within each pair of facing pockets. The corresponding pockets including a predetermined number of rotation preventing pockets on each of the fixed and orbiting rings for interacting with the bearing elements to prevent rotation of the orbiting member during orbital motion. Each of at least one hole of the inner surface of the housing and at least one hole in the axial end of the orbiting scroll member has a diameter smaller than that of each of said at least one opening of the fixed ring and said at least one opening of the orbiting ring.

The method of manufacturing the compressor comprises the following steps: (1) assembling a fixed ring assembly by securing the fixed ring to the housing by fixing means such that at least one opening of the fixed ring is secured to said at least one hole of the housing; (2) inserting a pin gage jig through the of opening of the fixed ring and into the hole of housing for measuring the eccentric relationship between the center of said opening of the fixed ring and the center of said hole of the housing; (3) assembling an orbiting ring assembly by securing the orbiting ring to the axial end of the orbiting scroll member by fixing means such that at least one opening of the orbiting ring is secured to at least one hole of the orbiting scroll member; (4) inserting a in gage jig through the opening of the orbiting ring and into the hole of the orbiting scroll member for measuring the eccentric relationship between the center of the opening of said orbiting ring and the center of the hole of said orbiting scroll member; (5) assembling a fixed ring assembly to an orbiting ring assembly which has the same or substantially similar eccentric characteristics as that of the fixed ring assembly.

Further objects, features, and advantages of this invention will be understood from the following detailed description of this invention and the accompanying drawings.

DETAILED DESCRIPTION OF THE PREFERRED EMBODIMENTS

Figure 1:
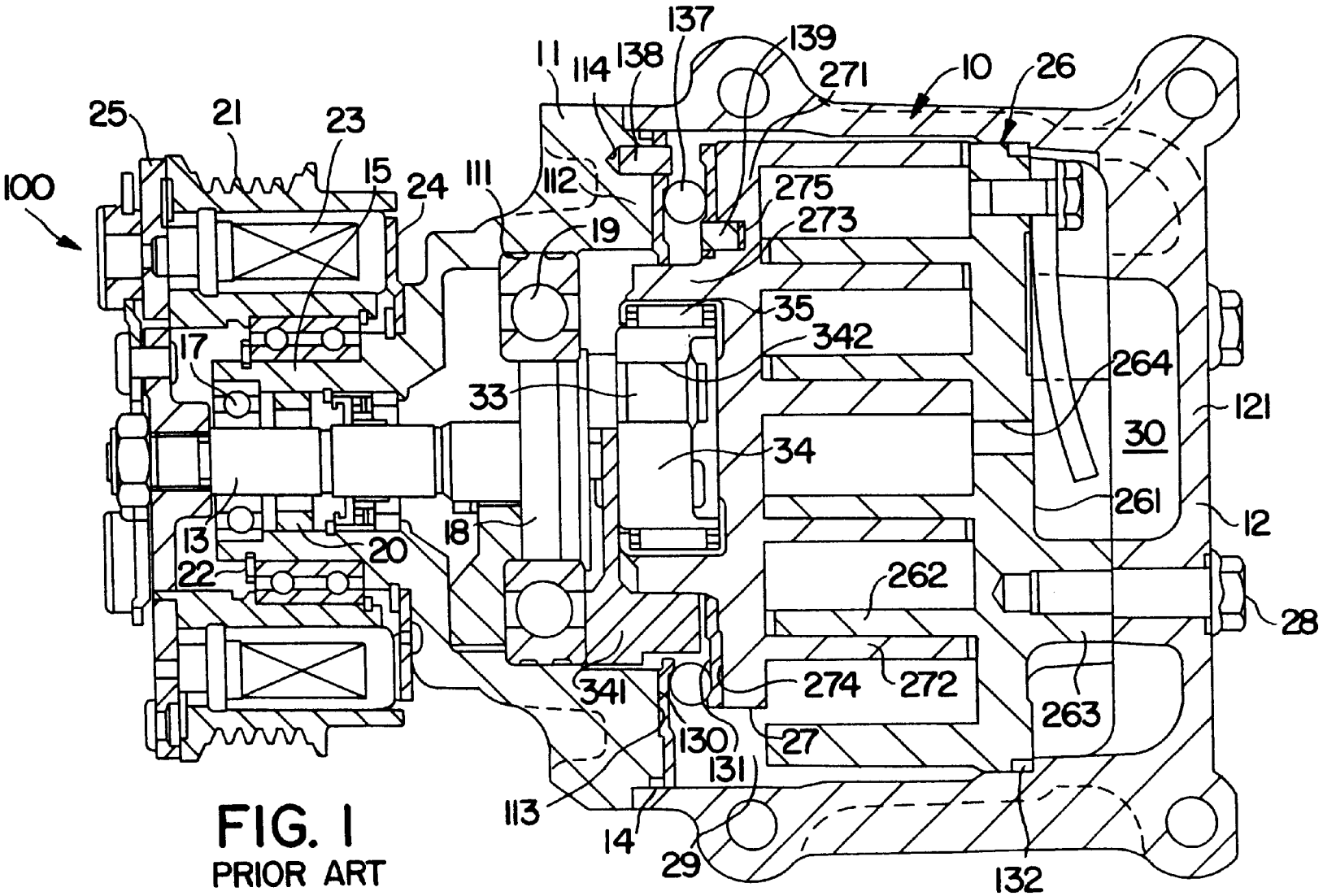
FIG. 1 PRIOR ART
FIG. 1 is a longitudinal cross-sectional view of a scroll type compressor with a ball coupling mechanism in accordance with a prior art.
Figure 2:
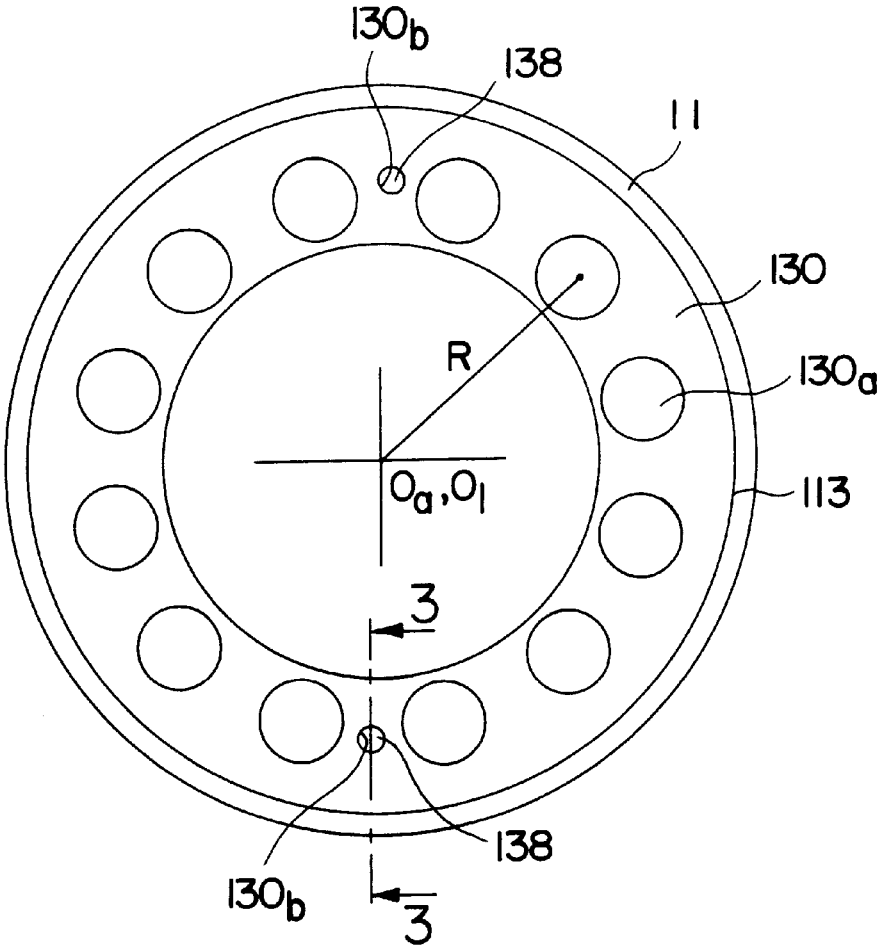
FIG.2 PRIOR ART
FIG. 2 is a diagrammatic plan view of a fixed race assembly of the scroll compressor in accordance with the prior art.
Figure 3:
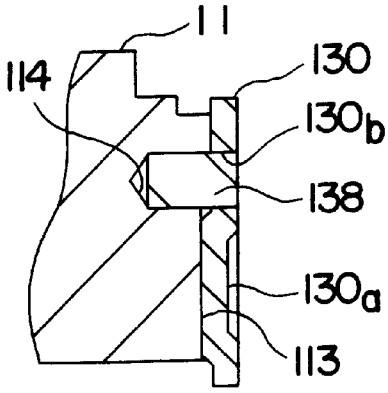
FIG.3 PRIOR ART
FIG. 3 is a vertical cross-sectional view taken along line 3—3 of FIG. 2.
Figure 4:
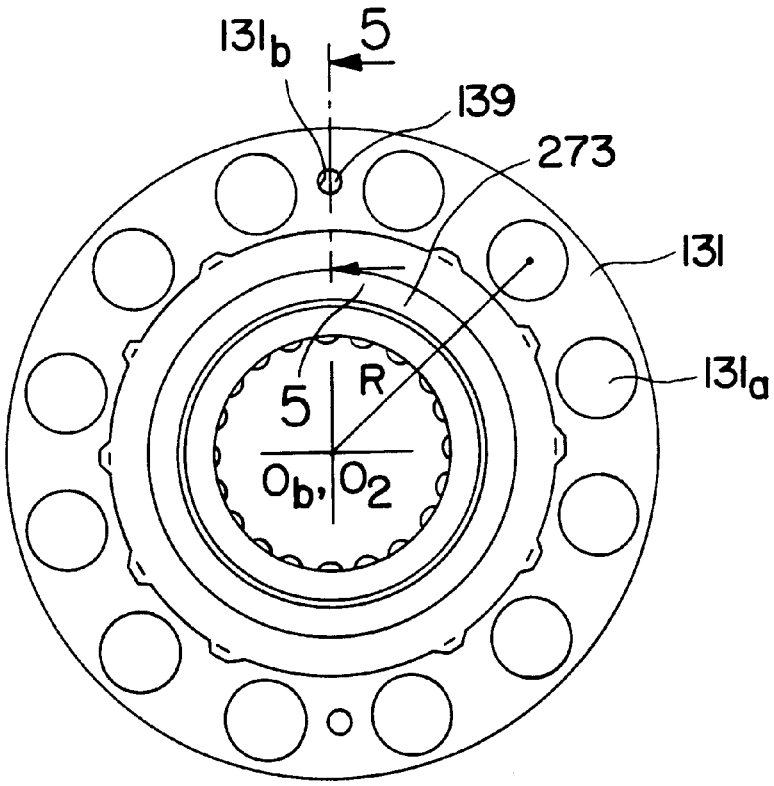
FIG. 4 PRIOR ART
FIG. 4 is a diagrammatic plan view of an orbital race assembly of the scroll type compressor in accordance with the prior art.
Figure 5:
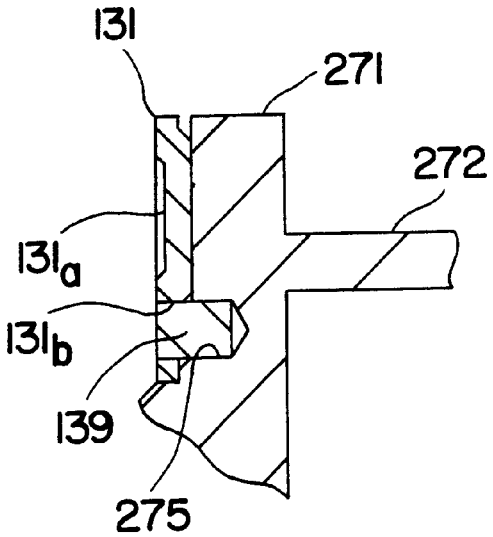
FIG. 5 PRIOR ART
FIG. 5 is a vertical cross-sectional view taken along line 5—5 of FIG. 4.
Figure 6:
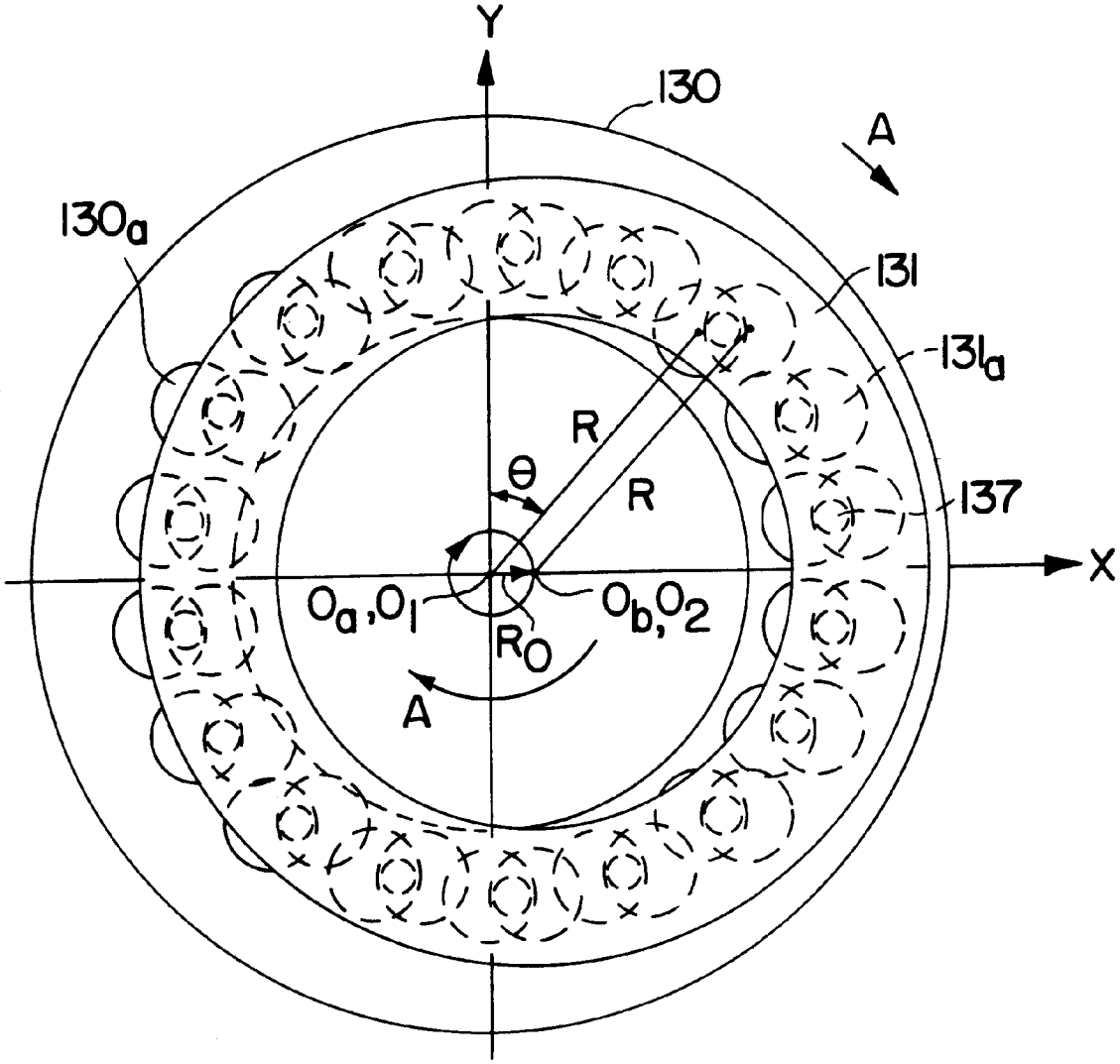
FIG. 6 PRIOR ART
FIG. 6 is a diagrammatic plan view of the rotation preventing/thrust bearing device of FIG. 1 illustrating the manner by which rotation is prevented.
Figure 7:
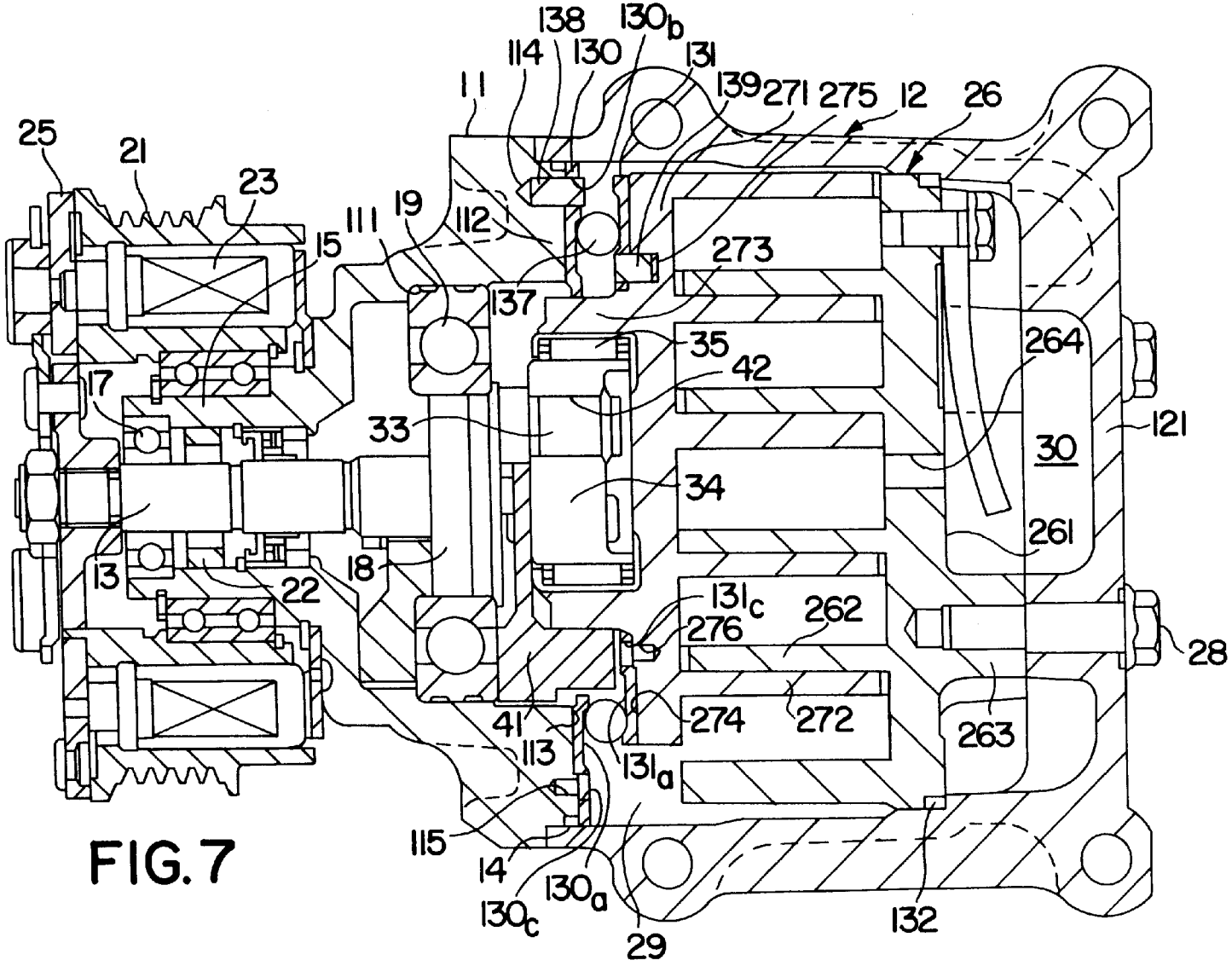
FIG. 7 is a longitudinal cross-sectional view of a scroll type compressor with a ball coupling mechanism in accordance with a embodiment of the present invention.

Referring to FIG. 7, a scroll type fluid compressor according to one embodiment of the invention is shown. In FIG. 7, the same reference numerals are used to denote identical elements of the compressor shown in the prior art of the FIG. 1. Similarly, identical through unprimed reference numerals will be used to denote elements of the compressor of FIG. 7 which are similar to elements shown in the prior art of FIG. 1.

Figure 8:
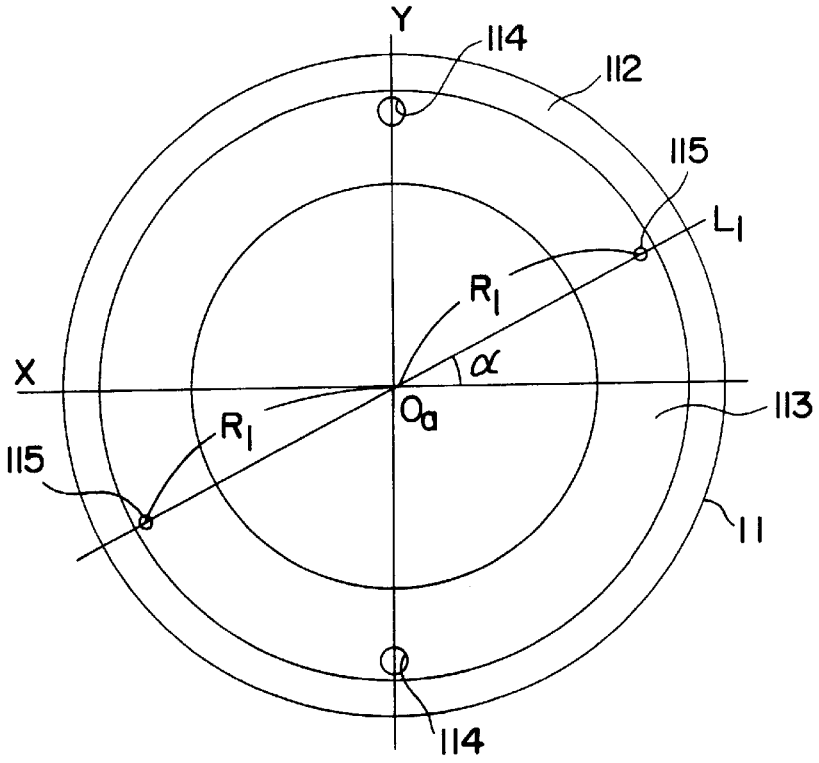
FIG. 8 is a plan view of a front end plate of the scroll compressor in accordance with the embodiment of the present invention.
Figure 9:
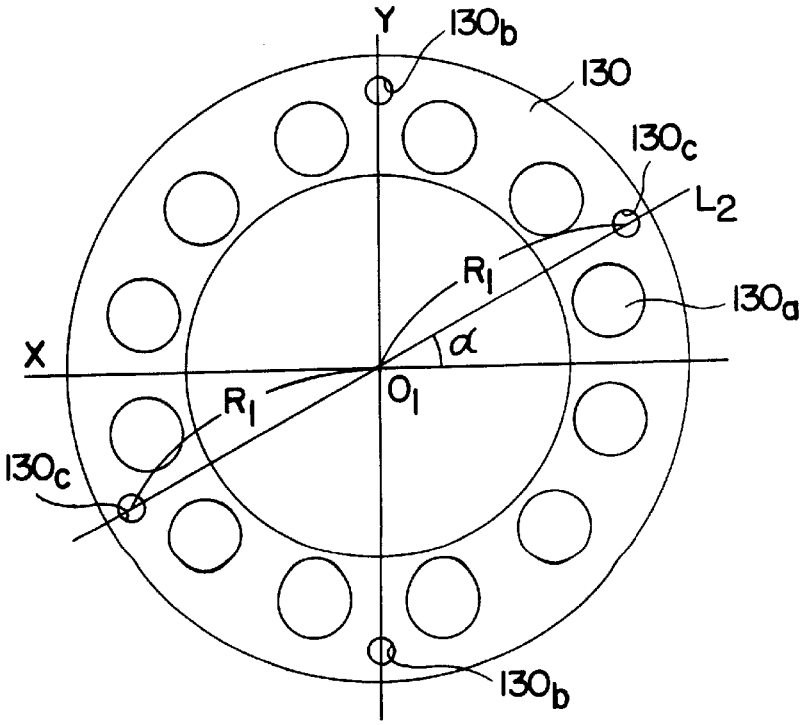
FIG. 9 is a plan view of a fixed race of the compressor in accordance with the embodiment of the present invention.

Referring to FIGS. 8 and 9, axial end surface 113 of front end plate 11 is illustrated with a horizontal line X and a vertical line Y, said lines intersecting at center $O_a$ of front end plate 11. Similarly, fixed race 130 is illustrated with a horizontal line X and a vertical line Y, said lines intersecting at center $O_1$ of fixed race 130. Axial end surface 113 is also shown with a line L1 intersecting center $O_a$, at an angle $\alpha$ with respect to line X. Similarly, fixed race 130 is shown with a line L2 intersecting center $O_1$, at the same angle $\alpha$ with respect to line X. Axial end surface 113 of front end plate 11 includes a pair of holes 115 on the surface thereof, said holes lying on line L1 and being radially opposite each other about center $O_a$ by a distance $R_1$. Fixed race 130 includes a pair of openings 130*c* on the surface thereof, said openings lying on line L2 and being radially opposite each other about center $O_1$ by approximately the same distance $R_1$ as holes 115 are separated from center $O_a$. Holes 115 are designed to generally, axially align with openings 130*c* when fixed race 130 is fixed to front end plate 11, though the diameter of each hole 115 is smaller than that of each opening 130*c*.

Axial end surface 113 of front end plate 11 includes a pair of holes 114 on the surface thereof, said holes lying on vertical line Y and being radially opposite each other about center $O_a$. Fixed race 130 includes a pair of openings 130*b* on the surface thereof, said openings lying on vertical line Y and being radially opposite each other about center $O_1$ by approximately the same distance as holes 114 are separated from center $O_a$. Holes 114 are designed to generally, axially align with openings 130*b* when fixed race 130 is fixed to front end plate 11. As shown in FIG. 7, fixed race 130 is secured to front end plate 11 by pins 138 which are inserted into holes 114 through openings 130*b*.

Figure 10:
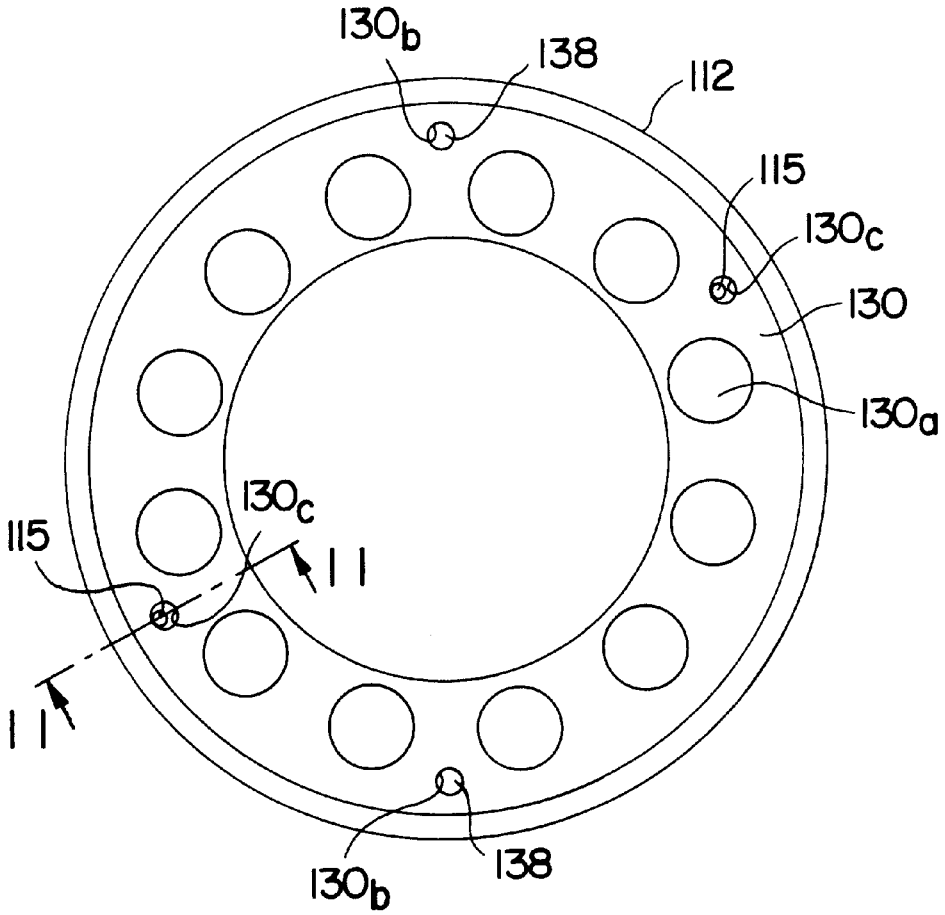
FIG. 10 is a diagrammatic plan view of the fixed race assembly of the compressor in accordance with the embodiment of the present invention.
Figure 11:
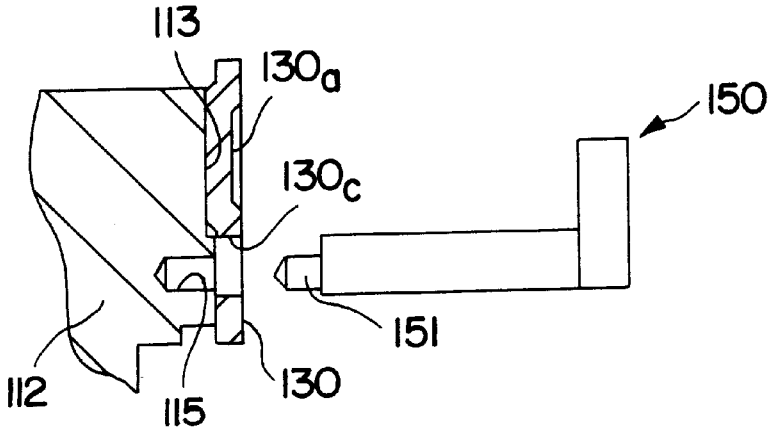
FIG. 11 is a vertical cross-sectional view taken along line 11—11 of FIG. 10.
Figure 12:
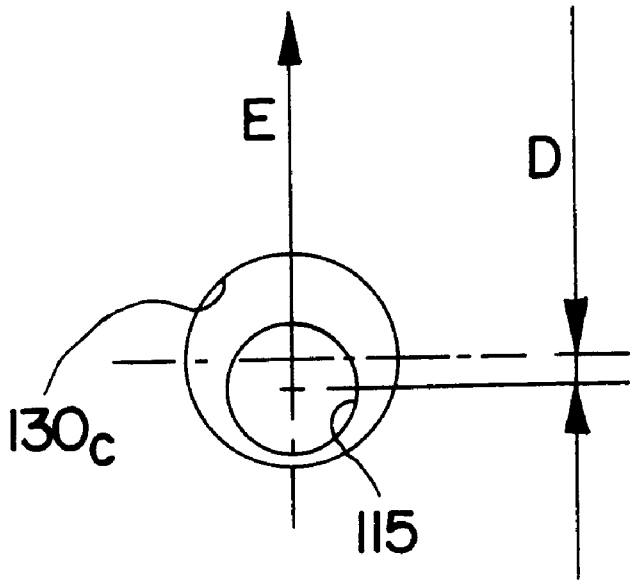
FIG. 12 is a diagrammatic plan view illustrating hole and opening of fixed or orbital race assembly of the compressor in accordance with the embodiment of the present invention.
Figure 13:
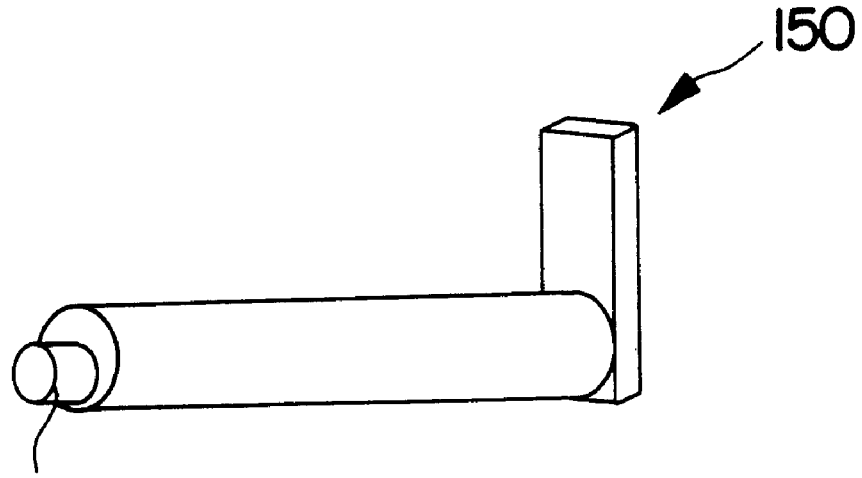
FIG. 13 is a perspective view illustrating a in gage jig in accordance with the embodiment of the present invention.

Referring to FIGS. 10 and 11, after fixed race 130 is secured to front end plate 11 with pins 138, a in gage jig 150 (as shown in FIG. 13) is used to measure the eccentricity of races during assembly. Pin gage jig 150 has gage in 151 formed at one end thereof; which gage in 151 is inserted through opening 130*c* and into hole 115. The person assembling the scroll-type compressor 100 will have a plurality of in gage jigs 150 of premarked and varying sizes that correspond to the extent to which the centers $O_1$ and $O_a$ are spaced apart after assembly (i.e., the measurement of eccentricity). The assembler will insert various in gage jigs 150 through opening 130*c*, rotate said jig and see if it fits into hole 115. When a particular in gage jig 150 can be completely inserted into hole 115, then the distance between the respective centers of opening 130*c* and hole 115 (i.e., the eccentric value D) is known based on the re-measured jig, and the orientation of a line connecting the two centers of opening 130*c* and hole 115 (i.e., the eccentric direction E) can also be determined from the orientation of the arm of the jig. FIG. 12 shows visually how eccentric value D and eccentric direction E are measured in connection with the two centers.

Figure 14:
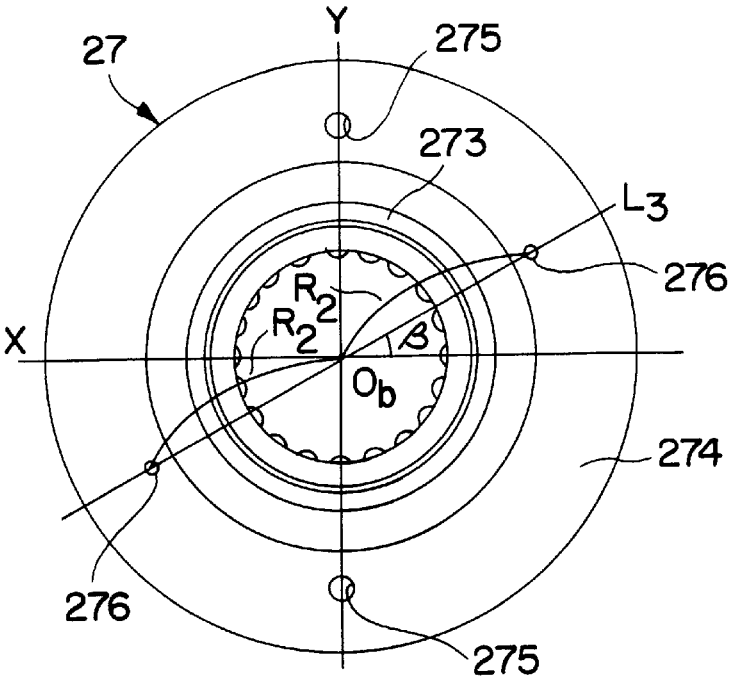
FIG. 14 is a plan view of a orbiting scroll of the scroll compressor in accordance with the embodiment of the present invention.
Figure 15:
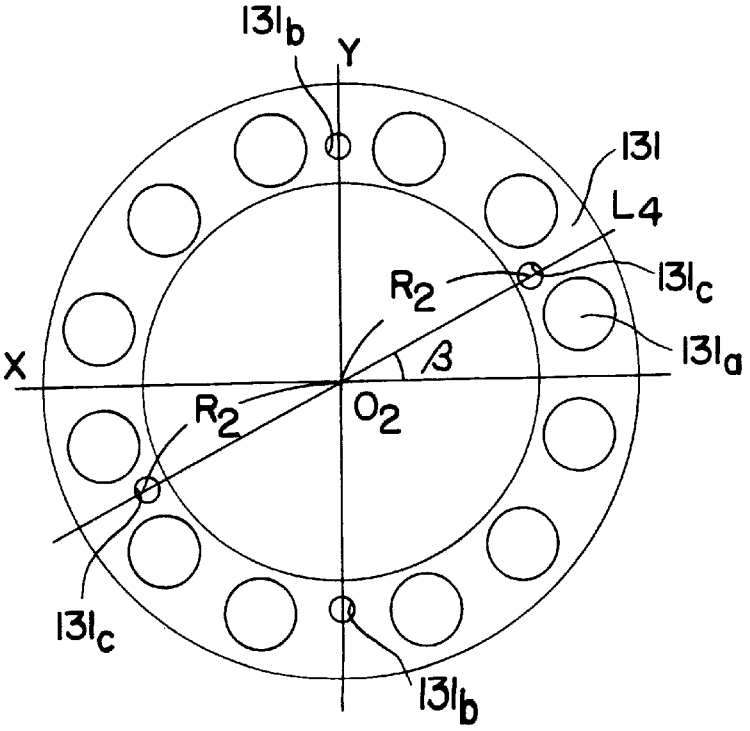
FIG. 15 is a plan view of the orbital race of the compressor in accordance with the embodiment of the present invention.

Referring to FIGS. 14 and 15, axial end surface 274 of orbiting scroll 27 is illustrated with a horizontal line X and a vertical line Y, said lines intersecting at center $O_b$ of orbiting scroll 27. Similarly, orbital race 131 is illustrated with a horizontal line X and a vertical line Y, said lines intersecting at center $O_2$ of orbital race 131. Axial end surface 274 is also shown with a line L3 intersecting the center $O_b$, at an angle $\beta$ with respect to line X. Similarly, orbital race 131 is shown with a line L4 intersecting center $O_2$, at the same angle $\beta$ with respect to line X. Axial end surface 274 of orbital scroll 27 includes a pair of holes 276 on the surface thereof, said holes lying on line L3 and being radially opposite each other about center $O_b$ by a distance $R_2$. Orbital race 131 includes a pair of openings 131*c* on the surface thereof, said openings lying on line L4 and being radially opposite each other about center $O_2$ by approximately the same distance $R_2$ as holes 276 are separated from center $O_b$. Holes 276 are designed to generally, axially align with openings 131*c* when orbital race 131 is fixed to orbital scroll 27, though the diameter of each hole 276 is smaller than that of each opening 131*c*.

Axial end surface 274 of orbital scroll 27 includes a pair of holes 275 on the surface thereof, said holes lying on vertical line Y and being radially opposite each other about center $O_b$. Orbital race 131 includes a pair of openings 131*b* on the surface thereof, said openings lying on vertical line Y and being radially opposite each other about center $O_2$ by approximately the same distance as holes 275 are separated from center $O^b$. Holes 275 are designed to generally, axially align with openings 131*b* when orbital race 131 is fixed to orbital scroll 27. As shown in FIG. 7, orbital race 131 is secured to orbital scroll 27 by pins 139 which are inserted into holes 275 through openings 131*b*.

Figure 16:
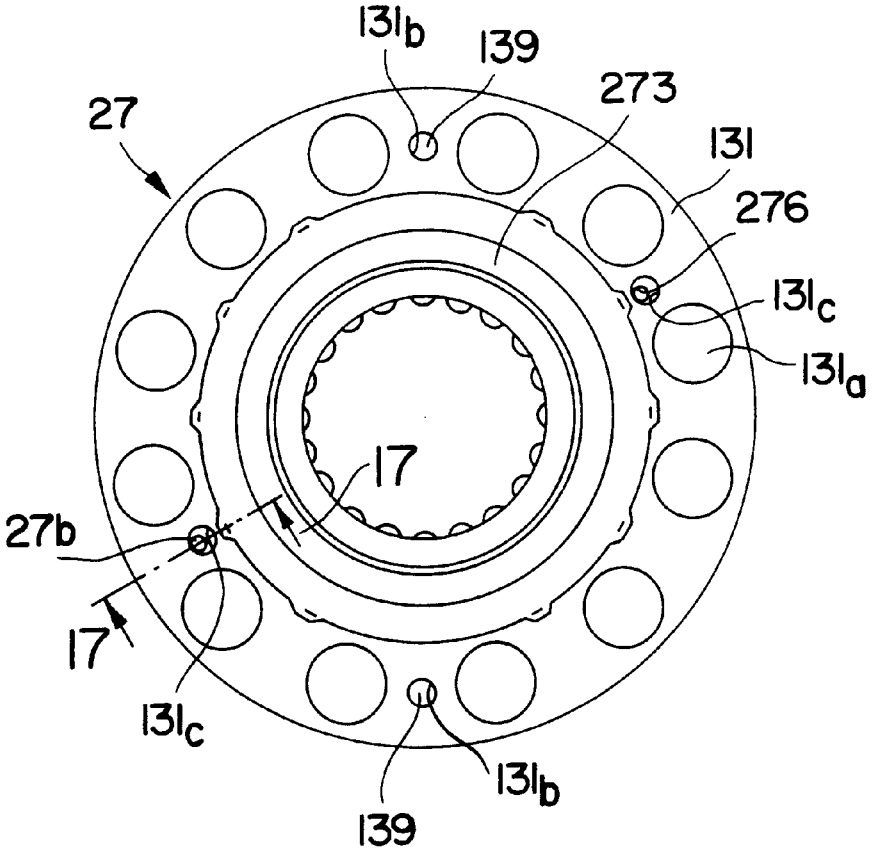
FIG. 16 is a diagrammatic plan view of the orbital race assembly of the scroll type compressor in accordance with the embodiment of the present invention.
Figure 17:
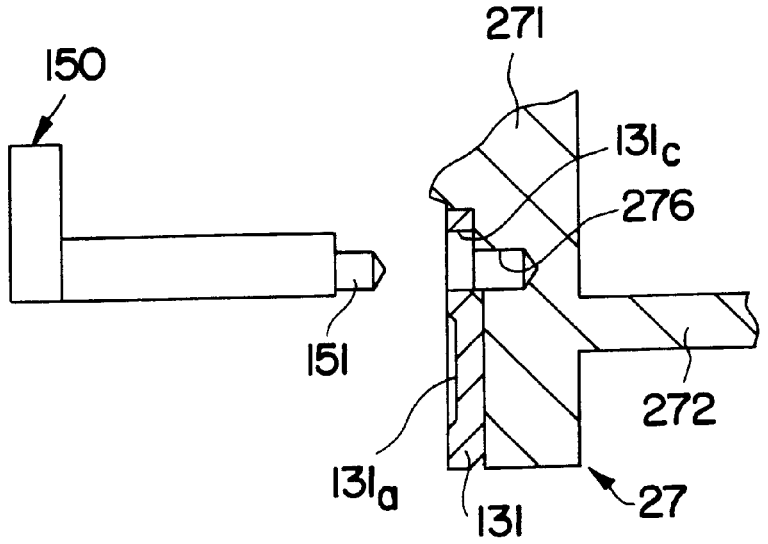
FIG. 17 is a vertical cross-sectional view taken along line 17—17 of FIG. 16.

Referring to FIGS. 16 and 17, after orbital race 131 is secured to orbital scroll 27 with pins 139, a in gage jig 150 is used to measure the eccentricity of races during assembly. Pin gage jig 150 has gage in 151 formed at one end thereof, which gage in 151 is inserted through opening 131*c* and into hole 276. The person assembling the scroll-type compressor 100 will have a plurality of in gage jigs 150 of remarked and varying sizes that correspond to the extent to which the centers $O_b$ and $O_2$ are spaced apart after assembly (i.e., the measurement of eccentricity). The assembler will insert various in gage jigs 150 through opening 131*c*, rotate said jig and see if it fits into hole 276. When a particular in gage jig 150 can be completely inserted into hole 276, then the distance between the respective centers of opening 131*c* and hole 276 (i.e., the eccentric value D) is known based on the re-measured jig, and the orientation of a line connecting the two centers of opening 131*c* and hole 276 (i.e., the eccentric direction E) can also be determined from the orientation of the arm of the jig. FIG. 12 shows visually how eccentric value D and eccentric direction E are measured in connection with the two centers.

It is desired to assemble a scroll type compressor 100 utilizing an orbital race assembly and a fixed race assembly that have substantially the same eccentric values D and substantially the same eccentric directions E. As a result, the resulting assembling helps to maintain suitable contact between both spiral elements 262 and 272 of the fixed scroll 26 and the orbiting scroll 27, respectively, and helps to prevent balls 137 from sticking out of pockets 130*a* or 131*a* of fixed race 130 and orbital race 131, respectively. The resulting arrangement and assembling also increases the durability of the fixed race 130 and orbital race 131, and results in higher quality compressor units.

This invention has been described in connection with the referred embodiments, but these embodiments are merely for example only, and the invention should not be construed as limited thereto. It should be apparent to those skilled in the art that other variations or modifications can be made within the scope defined by the appended claims. Thus, while the referred embodiments illustrate the invention as used in any scroll type fluid displacement apparatus, the invention can be used in any other orbiting member fluid displacement apparatus.

We claim:

1. A thrust bearing and coupling component for use in a fluid displacement apparatus, said thrust bearing and coupling component for simultaneously coupling an orbiting scroll member having a predetermined orbit radius and a fixed scroll member in a predetermined angular relationship with said orbiting scroll member, orbiting with respect to said fixed scroll member, and for supporting axial loads imposed on said scroll members, said orbiting scroll member having at least one hole formed on an axial end surface thereof, said fluid displacement apparatus having a housing with at least one hole formed on an inner surface thereof, said coupling component comprising;

a fixed ring fastened to said inner surface of said housing, and at least one opening formed eccentially in said fixed ring, whereas said at least one hole of is capable of being axially aligned with said at least one opening;

an orbiting ring fastened to the axial end surface of said orbiting scroll member facing said fixed ring, each of said fixed and orbiting rings having a plurality of corresponding pockets, each pocket on said fixed ring facing a pocket on said orbiting ring of similar size, pitch, and radial distance, and at least one opening formed in said orbiting ring;

a bearing element placed within each facing pair of said plurality of corresponding pockets, said corresponding pockets including a predetermined number of rotation preventing pockets on each of said fixed and orbiting rings for interacting with said bearing elements to prevent rotation of said orbiting member during orbital motion; and each of at least one said hole of said inner surface of said housing and said hole of said axial end surface of said orbiting scroll member having a diameter smaller than that of each of said at least one opening of said fixed ring and said orbiting ring, respectively, whereas said diameter of said at least one opening is measured at an end of said opening facing said at least one hole.

2. The thrust bearing and coupling component of claim 1, wherein said at least one hole of said inner surface of said housing and said at least one opening of said fixed ring are formed on circles having same radius around respective radial centers of said housing and said fixed ring.

3. The thrust bearing and coupling component of claim 1, wherein said at least one hole of said axial end surface of said orbiting scroll and said at least one opening of said orbiting ring are formed on circles having same radius around respective radial centers of said orbiting scroll and said orbiting ring.

4. The thrust bearing and coupling component of claim 1, wherein said housing, said orbiting scroll, said fixed ring and said orbiting ring further include holes therein for locating said fixed and orbiting rings to the housing and the orbiting scroll, respectively, by guide pins.

5. The thrust bearing and coupling component of claim 1, wherein said bearing element is a ball bearing.

6. A scroll type fluid displacement apparatus comprising:

a housing having a front end plate and at least one hole formed on an inner surface thereof;

a fixed member attached to said housing;

an orbiting member having an end plate from which an annular member extends, said fixed and orbiting members interfitting at a radial offset to establish at least one line contact to separate a fluid outlet from a fluid inlet, said orbiting member having at least one hole formed on an axial end surface of said orbiting member;

a driving mechanism including a rotational drive shaft connected to said orbiting members to drive said orbiting member in an orbiting motion;

a rotation preventing and thrust bearing means connected to said orbiting member for carrying axial loads from said orbiting member and preventing the rotation of said orbiting member, so that at least one line contact moves toward a compressor discharge side during orbital motion, said rotation preventing and thrust bearing means including a fixed ring fastened to an inner surface of said housing and an orbiting ring fastened to an axial end surface of said end plate of said orbiting member facing said fixed ring, said fixed and orbiting rings having a plurality of corresponding circular pockets, each pocket on said fixed ring facing a pockets on said orbiting ring corresponding in size, pitch, and radial distance from the respective centers of said orbiting and fixed rings, and at least one opening formed eccentrically in each of said orbiting and fixed rings, whereas said at least one hole is capable of being axially aligned with said at least one opening, respectively said rotation preventing and thrust bearing means further including a plurality of bearing elements, each of which is placed within a facing pair of said corresponding pockets, said corresponding pockets including a predetermined number of rotation preventing pockets on each of said fixed and orbiting rings for interacting with said bearing elements to prevent rotation of said orbiting member during orbital motion; and each of said at least one hole of said inner surface of said housing and said axial end surface of said orbiting scroll member having a diameter smaller than that of each of said at least one opening of said fixed rings and said orbiting ring, respectively, whereas said diameter of said at least one opening is measured at an end of said opening facing said at least one hole.

7. The scroll type fluid displacement apparatus of claim 6, wherein said at least one hole of said inner surface of said housing and said opening of said fixed ring are formed on circles having same radius around respective radial centers of said housing and said fixed ring.

8. The scroll type fluid displacement apparatus of claim 6, wherein said at least one hole of said axial end surface of said orbiting scroll and said opening of said orbiting ring are formed on circles having same radius around respective radial centers of said orbiting scroll and said orbiting ring.

9. The scroll type fluid displacement apparatus of claim 6, wherein said housing, said orbiting scroll, said fixed ring and said orbiting ring further include holes therein for locating said fixed and orbiting rings to the housing and the orbiting scroll, respectively, by guide pins.

10. The scroll type fluid displacement apparatus of claim 6, wherein said bearing element is a ball bearing.

11. A method of manufacturing a scroll type fluid displacement apparatus, said apparatus having:

a housing including a front end plate and at least one hole formed on an inner surface of said housing;

an orbiting ring assembly including an orbiting member having an end plate from which an annular member extends and an orbiting ring fastened to an axial end surface of said end plate of said orbiting member, said orbiting member having at least one hole formed on an axial end surface of said orbiting member;

a fixed ring assembly attached to said housing and including a fixed ring fastened to an inner surface of said housing facing said orbiting ring of said orbiting assembly, said fixed ring having at least one opening formed in said fixed ring;

each of said fixed and orbiting rings having a plurality of corresponding pockets, each pocket on said fixed ring facing a pocket on said orbiting ring correspondence in size, pitch, and radial distance, and at least one opening formed in said orbiting ring;

a rotation preventing and thrust bearing means connected to said orbiting assembly for carrying axial loads from said orbiting assembly and preventing the rotation of said orbiting assembly, so that at least one line contact moves toward a compressor discharge side during orbital motion, said rotation preventing and thrust bearing means further including a plurality of bearing elements, each of which is placed within a facing pair of said corresponding pockets, said corresponding pockets including a predetermined number of rotation preventing pockets on each of said fixed and orbiting rings for interacting with said bearing elements to prevent rotation of said orbiting member during orbital motion; and wherein each of said at least one holes of said inner surface of said housing and said axial end surface of said orbiting scroll member has a diameter smaller than that of each of said at least one opening of said fixed ring and said orbiting ring, said method comprising the steps of:

assembling the fixed ring assembly by securing said fixed ring to said housing by fixing means such that said at least one opening of said fixed ring is fixed to said at least one hole of said housing;

inserting a pin gage jig through said opening of said fixed ring and into said hole of said housing for measuring the eccentric relationship between the center of said opening in said fixed ring and the center of said hole of said housing;

assembling the orbiting ring assembly by securing said orbiting ring to said axial end surface of said orbiting scroll member by fixing means such that said at least one opening of said orbiting ring is fixed to said at least one hole of said orbiting scroll member;

inserting a in gage jig through said opening of said orbital ring and into said hole of said fixed orbiting scroll member for measuring eccentric relationship between the center of said opening of said orbital ring and the center of said hole of said fixed orbiting scroll member; and assembling a fixed ring assembly to an orbiting ring assembly which has the same or substantially similar eccentric characteristics as that of the fixed ring assembly;

assembling said fixed ring assembly to said orbiting ring assembly, said fixed ring assembly and said orbiting ring assembly having same or substantially similar eccentric measurements.

12. A scroll type fluid displacement apparatus manufactured by the method of claim 11.

* * * * *